United States Patent [19]

Tahara et al.

[11] Patent Number: 4,719,484

[45] Date of Patent: Jan. 12, 1988

[54] PHOTOSENSITIVE MATERIAL GUIDE STRUCTURE FOR DEVELOPING APPARATUS

[75] Inventors: Toshiro Tahara; Kaoru Uchiyama; Seiichi Yamazaki; Kiichiro Sakamoto, all of Kanagawa, Japan

[73] Assignee: Fuji Photo Film Co., Ltd., Kanagawa, Japan

[21] Appl. No.: 893,745

[22] Filed: Aug. 6, 1986

[30] Foreign Application Priority Data

Aug. 6, 1985 [JP] Japan ..... 60-172999
Oct. 3, 1985 [JP] Japan ..... 60-220904

[51] Int. Cl.[4] ..... G03D 3/08

[52] U.S. Cl. ..... 354/320; 354/338; 226/181; 226/196

[58] Field of Search ..... 354/319, 320, 321, 322, 354/338, 339; 226/181, 189, 190, 196, 184

[56] References Cited

U.S. PATENT DOCUMENTS 4,255,038 3/1981 Simon et al. ..... 354/319
4,286,860 9/1981 Gursky et al. ..... 226/181
4,326,791 4/1982 Beer et al. ..... 226/189
4,544,253 10/1985 Kummerl ..... 354/321

FOREIGN PATENT DOCUMENTS 1393566 5/1975 United Kingdom ..... 354/320

*Primary Examiner*—A. A. Mathews
*Attorney, Agent, or Firm*—Sughrue, Mion, Zinn, Macpeak, and Seas

[57] ABSTRACT

A photosensitive material guide structure for use in a developing apparatus adapted to develop a photosensitive material having been subjected to light exposure has at least one pair of feed rollers which feed forward the photosensitive material while clamping it therebetween within the developing apparatus. Both axial end portions of at least one of the pair of feed rollers are reduced in diameter. Accordingly, when the rollers clamp the photosensitive material to feed it, both the lateral edge portions of the photosensitive material are subjected to a clamping force which is weaker than that applied to the other portion of the material.

20 Claims, 11 Drawing Figures

PHOTOSENSITIVE MATERIAL GUIDE STRUCTURE FOR DEVELOPING APPARATUS

BACKGROUND OF THE INVENTION

1. Field of the Invention

The present invention relates to a photosensitive material guide structure for use in a developing apparatus which develops a photosensitive material having been subjected to light exposure, the guide structure being adapted to guide such photosensitive material within the developing apparatus.

2. Description of the Related Art

Photographic paper which is one example of photosensitive materials is subjected to light exposure so that an image is formed thereon, and is then transported to a developing apparatus.

In this developing apparatus, the photographic paper is transported between a plurality of feed rollers, and while doing so, it is dipped in a processing liquid so as to be developed, and is then transported to a subsequent process.

A typical conventional photographic paper guide structure is arranged such that photographic paper is sequentially transported between a plurality of pairs of rollers so as to contact a developer within the areas between these pairs of rollers, and thereby developed.

During the transportation of the photographic paper within the developing apparatus, both lateral edge portions of the paper are readily soaked with the developer and therefore swell more easily than the laterally central portion of the paper. In consequence, when the swollen edge portions are clamped between rollers so as to be fed forward, they are subjected to a larger pressure than that applied to the laterally central portion of the photographic paper. As a result, a relatively large amount of developer soaks into the edge portions and may change the quality thereof, resulting in discoloration such as yellowing.

SUMMARY OF THE INVENTION

In view of the above-described circumstances, it is a primary object of the present invention to provide a photosensitive material guide structure for a developing apparatus which is so designed that a developer is prevented from soaking into lateral edge portions of a photosensitive material being transported between a plurality of pairs of rollers, thereby eliminating the fear of the lateral edge portions being changed in quality, e.g., discolored.

To this end, the present invention provides a photosensitive material guide structure for a developing apparatus which has at least one pair of feed rollers adapted to feed forward a photosensitive material while clamping it therebetween, wherein both axial end portions of each of the rollers ar reduced in diameter to reduce the clamping force applied to both lateral edge portions of the photosensitive material.

By virtue of the above-described arrangement, the clamping force applied by the rollers to the lateral edge portions of the photosensitive material is reduced, so that, even when said edge portions have swollen with the developer, there is no fear of these portions being changed in quality, e.g., discolored.

Both of a pair of feed rollers which are in contact with each other may be reduced in diameter at both axial end portions thereof. Alternatively, both axial end portions of one of the rollers alone may be reduced in diameter.

When a plurality of pairs of rollers for guiding a photosensitive material are provided, it is possible to reduce the diameter of both axial end portions of rollers among them which are disposed on the downstream side of a predetermined position as viewed in the direction in which the photosensitive material is transported. More specifically, when a photosensitive material is advanced while being dipped in a developer, the developer starts to soak into this photosensitive material when a certain period of time has elapsed after the material has entered the developer. Therefore, it is preferable to clamp or hold the lateral edge portions of the photosensitive material by the rollers under transporting conditions similar to those for the laterally central portion so as to make uniform the progress of developing in its early stage in order to prevent uneven developing until the lateral edge portions start to swell with the developer, and after they have started to swell, the clamping force is reduced in order to prevent the generation of stains due to soaking with the developer.

DESCRIPTION OF THE PREFERRED EMBODIMENTS

Figure 1:
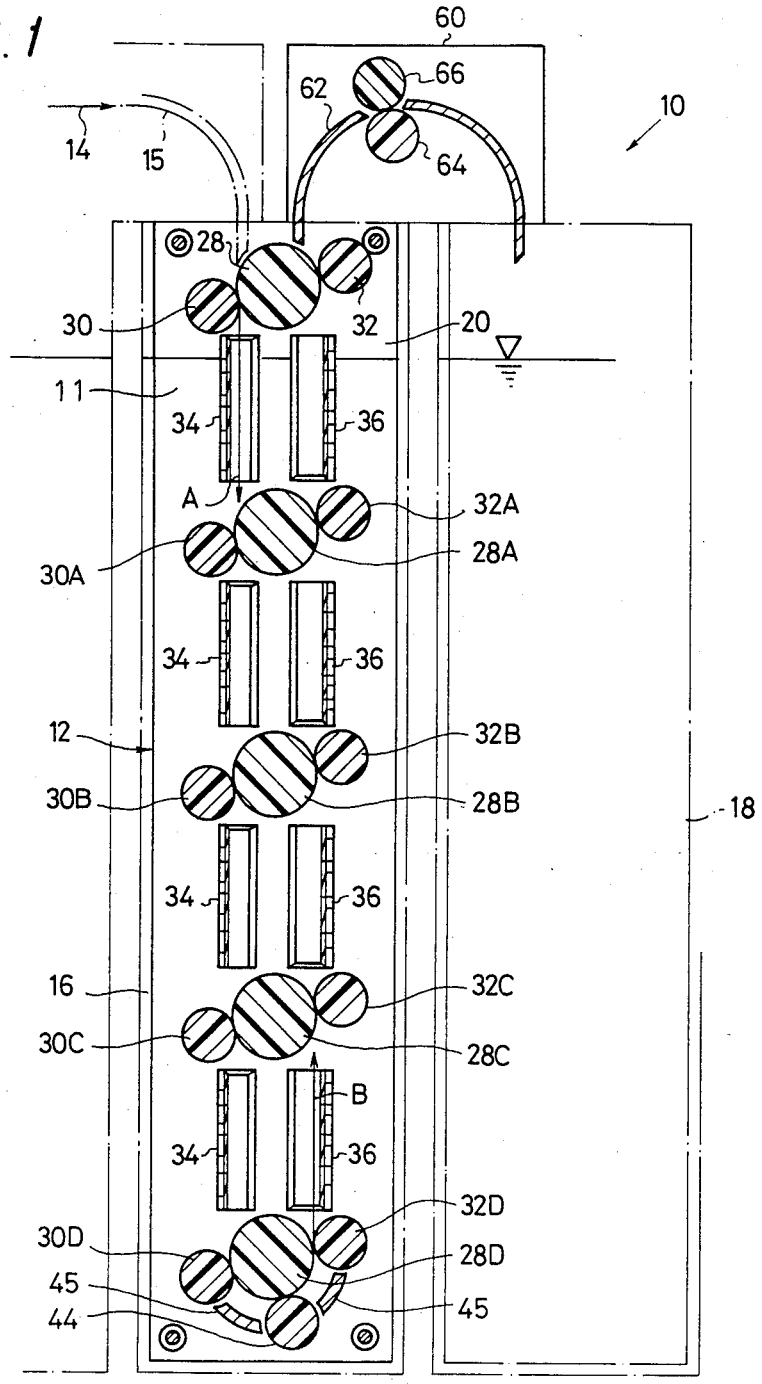
FIG. 1 shows a first embodiment of the photosensitive material guide structure for a developing apparatus according to the present invention, which corresponds to a sectional view taken along the line I—I in FIG. 2.
Figure 2:
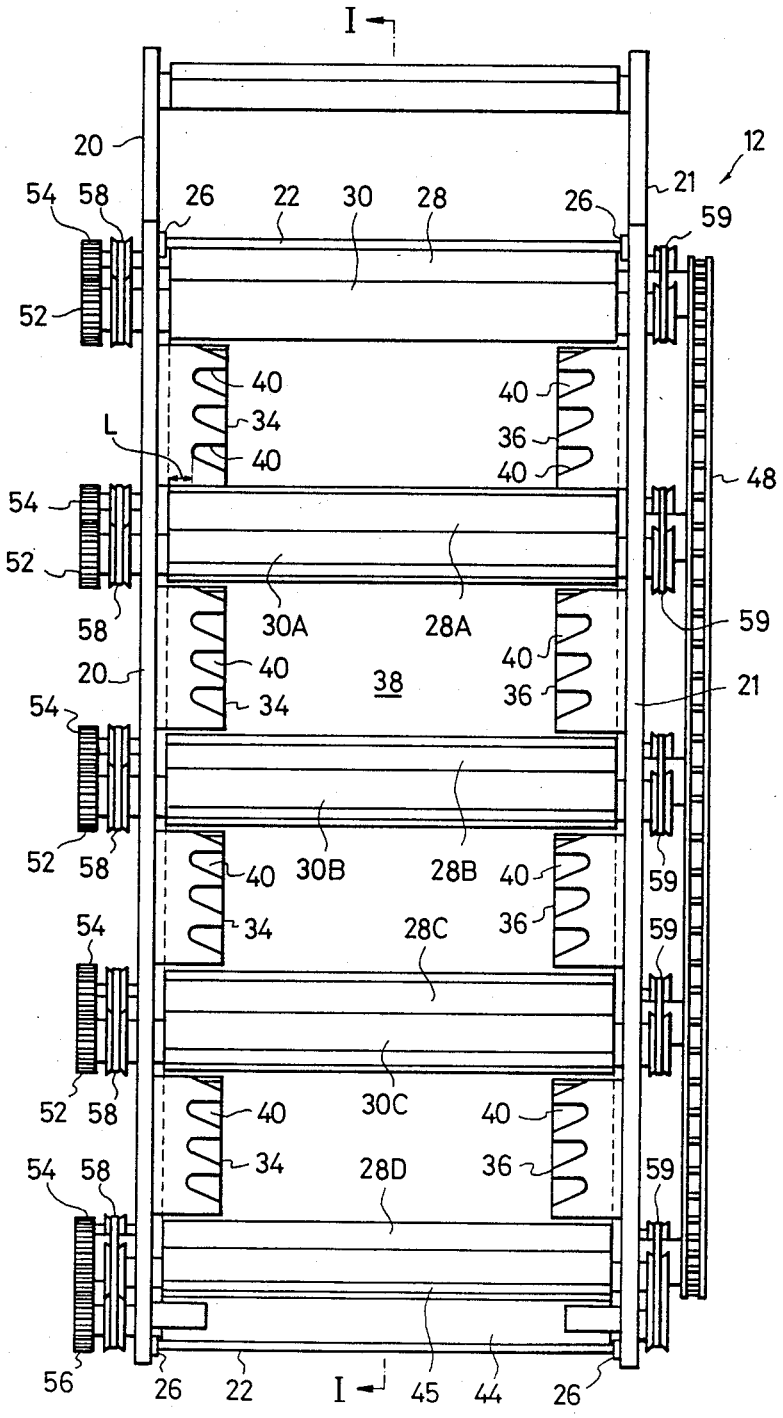
FIG. 2 is a side view of the guide structure shown in FIG. 1 as viewed from the left-hand side thereof.

The present invention will be described hereinunder in detail with reference to the accompanying drawings.

FIGS. 1 to 5 show in combination a first embodiment in which the present invention is applied to a rack means 12 which is immersed in a developer 11 accommodated within a developing apparatus 10. More specifically, photographic paper 1 which is one example of photosensitive materials and which has been finished with light exposure by means of a printer is fed into the developing apparatus 10 while being guided by a bent guide plate 15. The photographic paper 1 is then guided by the rack means 12 in such a manner that it is dipped in the developer 11 contained in a developing tank 16 while making a U-turn, and then drawn out of the developing tank 16. The photographic paper 1 is then transported so as to draw an inverted U-shaped locus before being fed into a subsequent processing tank 18.

Figure 4:
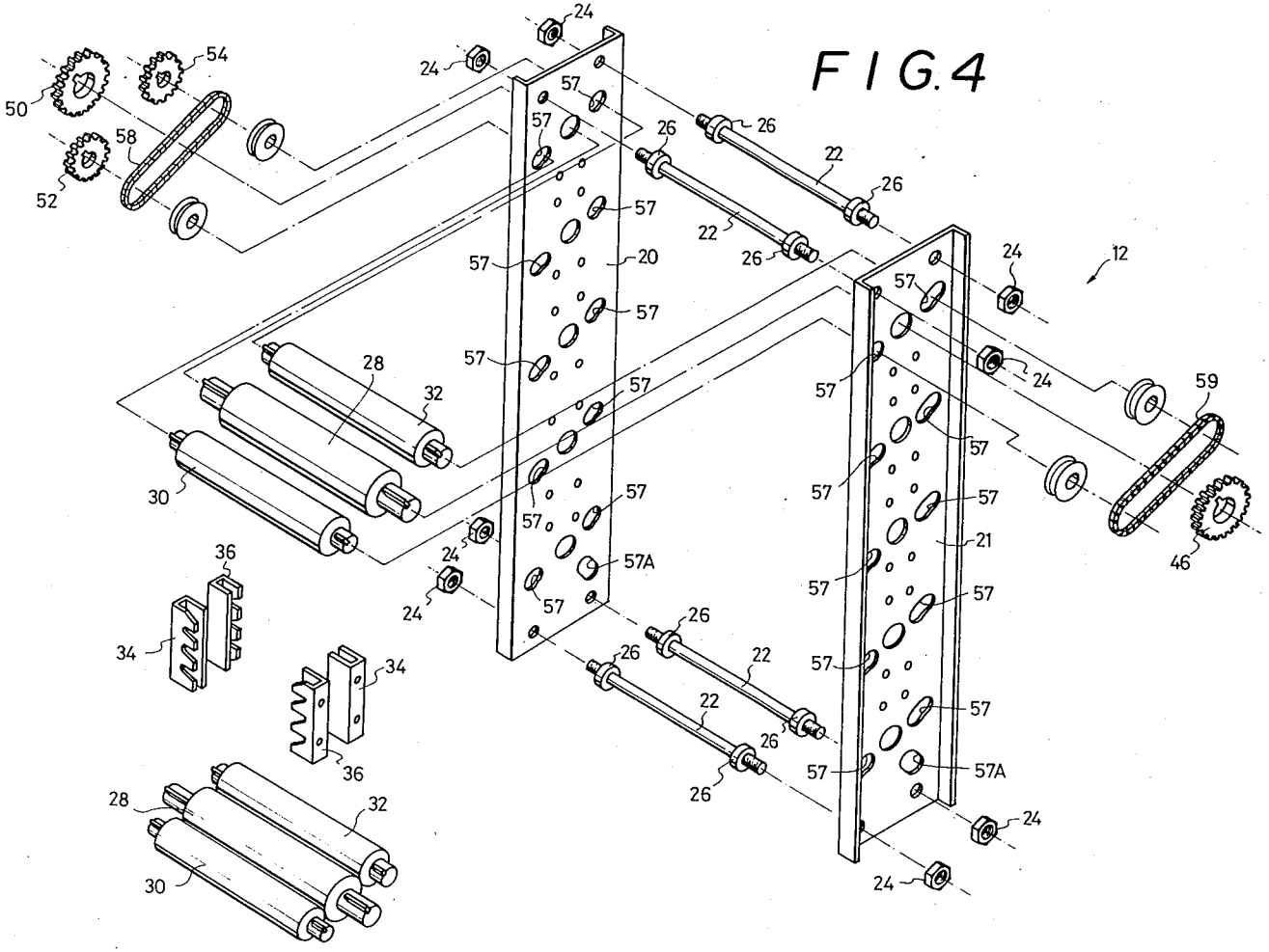
FIG. 4 is an exploded perspective view of rack means in accordance with the first embodiment.

As also shown in FIG. 4, the rack means 12 is composed of a pair of opposing side plates 20 and 21 and a plurality of support rods 22 which are stretched between the side plates 20 and 21. Nuts 24 are respectively screwed onto the end portions of the support rods 22 which project from the side plates 20 and 21, and the side plates 20 and 21 are thereby secured to each other at a predetermined spacing. For this purpose, collars 26 are provided on the intermediate portion of each support rod 22 so as to abut against the respective inner sides of the side plates 20 and 21.

A feed roller 28 is provided near the upper end of the rack means 12 in such a manner that both axial end portions thereof are rotatably supported by the respective laterally central portions of the side plates 20 and 21. Feed rollers 30 and 32 are rotatably supported adjacent to the feed roller 28 in such a manner that these rollers 30 and 32 are in contact with the roller 28 from two opposite sides thereof. The feed rollers 30 and 32 have a diameter smaller than that of the feed roller 28. Feed rollers 28A, 28B, 28C and 28D are disposed directly below the feed roller 28 at equal spacings in such a manner that both axial end portions of each roller are rotatably supported by the side plates 20 and 21, respectively. Similarly, feed rollers 30A, 30B, 30C and 30D are disposed directly below the feed roller 30, and feed rollers 32A, 32B, 32C and 32D are disposed directly below the feed roller 32, each of these rollers being rotatably supported at both axial end portions thereof by the side plates 20 and 21, respectively.

The straight line which intersects the respective axes of the feed rollers 28A to 28D extends parallel to the direction (indicated by the arrow A in FIG. 1) in which the photographic paper 14 is transported.

Figure 6:
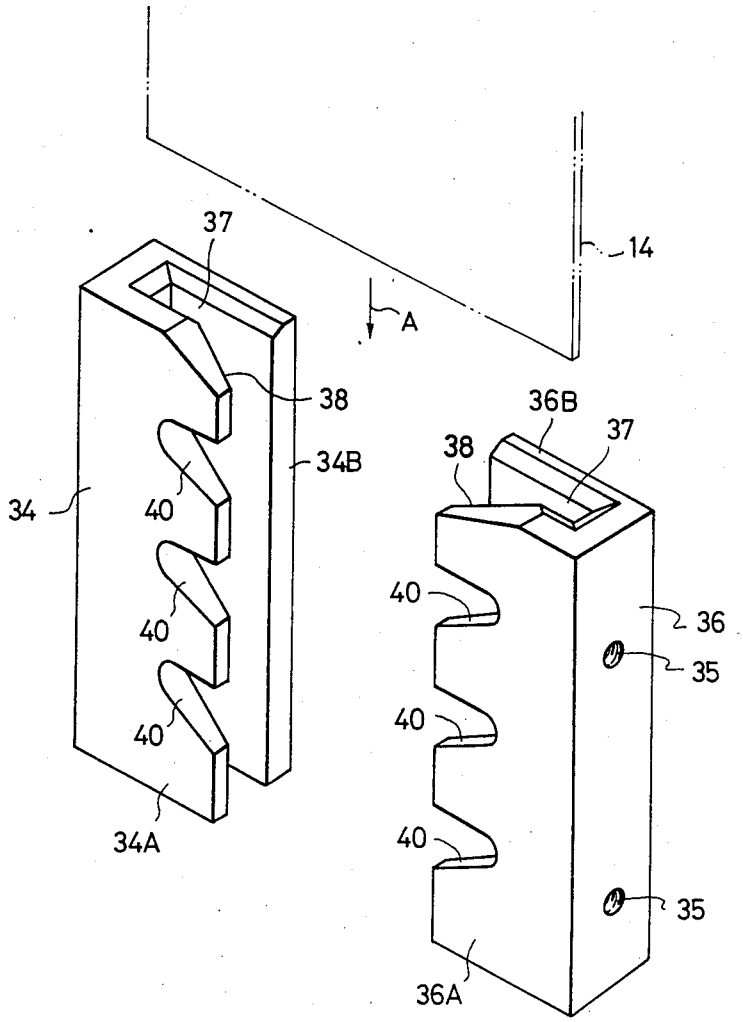
FIG. 6 is an enlarged perspective view of guide members in accordance with the first embodiment.
Figure 7:
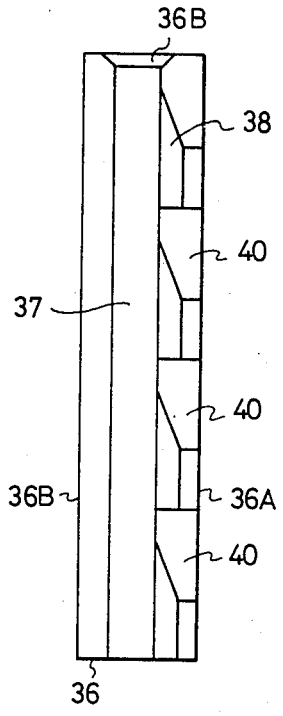
FIG. 7 is a side view of one of the guide members shown in FIG. 6.

Guide members 34 and 36 are respectively secured to the side plates 20 and 21 for guiding the photographic paper 14 which is fed out from the area between the feed rollers 28 and 30 so as to advance toward the feed rollers 28A and 30A. As shown in FIG. 6, the guide member 34 has parallel leg portions 34A and 34B which respectively project from both lateral ends thereof, thus having a U-shaped planar configuration as a whole. The guide member 36 has parallel leg portions 36A and 36B in the same manner as the guide member 34. A slit 37 for passing photographic paper 14 is defined in the center of each of the guide members 34 and 36. Thus, the guide members 34 and 36 are adapted to guide both lateral edges of the photographic paper 14.

The guide member 34 is secured to the side plate 20, and the guide member 36 to the side plate 21. Internal threads 35 are cut in each of the guide members 34 and 36 in order to secure these members to the respective side plates. The guide members 34 and 36 are disposed in such a manner that the respective slits 37 face each other. The space between the guide members 34 and 36 defines a developer passage, thereby allowing the developer 11 to effectively contact the photographic paper 14 being transported.

The respective leg portions 34A and 36A of the guide members 34 and 36, which are located on the outer side, that is, on the side of the guide members 34 and 36 which is closer to the feed roller 30 rather than to the feed roller 28, respectively have slanting surfaces 38 extending toward the distal ends thereof in such a manner that the respective widths of the slits 37 are increased, thereby preventing the leading end of the transported photographic paper 14 from being accidentally caught by the edges of the slits 37, and thus allowing the photographic paper 14 to be reliably guided into the slits 37.

In addition, a plurality of substantially V-shaped notches 40 are formed in each of the leg portions 34A and 36A from the distal end thereof at a predetermined regular spacing, thereby allowing the developer 11 to pass also near the lateral edges of the photographic paper 14 being guided within the slits 37. These notches 40 have a depth smaller than the depth of the slits 37. In consequence, a portion having a length L (see FIG. 2) and provided with no notch is defined between the bottom surface of each slit 37 and the bottom surfaces of the notches 40, thereby preventing both lateral edges of the leading end of the photographic paper 14 from being caught by the notches 40 when the paper 14 is moved within the slits 37.

In addition to the guide members 34 and 36 which are disposed between the feed rollers 30 and 30A, guide rollers 34 and 36 are disposed between other pairs of feed rollers so as to guide both lateral edges of the photographic paper 14. More specifically, guide members 34 and 36 are also provided for the photographic paper 14 which is fed out from the area between the feed rollers 28D and 32D, guided between a plurality of pairs of rollers and upwardly fed into the area beween the feed rollers 28 and 32 in the direction of the arrow B in FIG. 1. The leg plates 34A and 36A of these guide members 34 and 36 are, however, disposed in such a manner as to face the outside of the rack means 12. Thus, all the notches 40 are allowed to face the emulsion-coated side of the photographic paper 14.

The respective axes of the rollers 30 to 30D are disposed slightly below the axes of the respective associated feed rollers 28 to 28D. Contrarily, the respective axes of the feed rollers 32 to 32D are disposed slightly above the axe of the respective associated feed rollers 28 to 28D.

In consequence, the leading end of the photographic paper 14 which is fed out from the area between the feed rollers 28 and 31 is biased from the photographic paper transporting direction (indicated by the arrow A in FIG. 1) so as to move toward the respective leg portions 34B and 36B of the guide members 34 and 36 which are disposed in the manner shown in FIG. 6. Similarly, when the photographic paper 14 is fed out from the area between each pair of feed rollers, the leading end thereof is directed toward the leg portions 34B and 36B of subsequent guide members 34 and 36. Consequently, when the photographic paper 14 is fed out from the area between one pair of feed rollers, one side thereof is always allowed to approach or contact the leg portions 34B and 36B of subsequent guide members 34 and 36. There is therefore no fear of the other side of the photographic paper 14 coming into contact with the leg portion 34A or 36A before the paper 14 reaches a pair of subsequent feed rollers. Accordingly, the photographic paper 14 is transported in such a manner that the emulsion-coated side thereof defines said other or second side, thereby enabling elimination of the problem that the emulsion-coated side of the paper 14 may contact the leg portion 34A or 36A while advancing between pairs of feed rollers.

A roller 44 for U-turn is provided below the feed roller 28D in such a manner that these rollers are in contact with each other, and the axis of the roller 44 is disposed at equal distances from the respective axes of the feed rollers 30D and 32D.

Guide plates 45 for U-turn are disposed between the roller 44 and the feed rollers 30D, 32D in such a manner that the guide plates 45 extend over the whole area in the lateral direction of the locus of the photographic paper 14 being transported. The guide plates 45 are stretched between the side plates 20 and 21 and have a circular cross-section as viewed in the axial direction of the roller 44. Accordingly, these guide plates 45 are adapted to respectively guide the photographic paper 14 fed out from the area between the feed rollers 28D and 30D into the area between the feed roller 28D and the roller 44 for U-turn and guide the paper 14 fed out from the area between the rollers 28D and 44 into the area between the rollers 28D and 32D.

Figure 8:
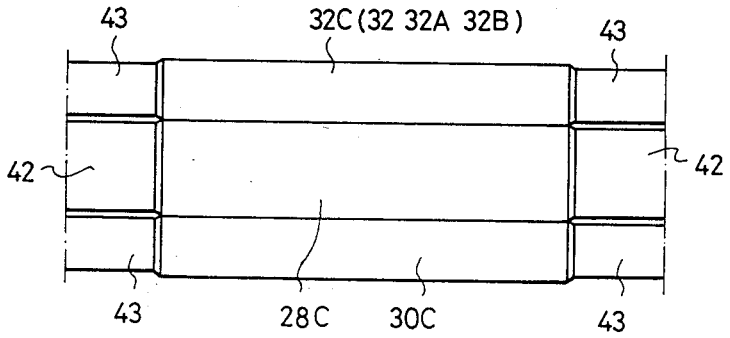
FIG. 8 is a plan view of one group of feed rollers, which shows them in a contact state.

Referring next to FIG. 8, the feed rollers 28C, 30C and 32C respectively have smaller-diameter portions 42 and 43 at both axial ends thereof. These smaller-diameter portions 42 and 43 are provided so as to oppose both lateral edge portions of the photographic paper 14 when transported, thereby reducing the clamping force applied to the lateral edge portions of the photographic paper 14 being transported.

More specifically, the photographic paper 14 is passed through the pair of feed rollers 28 and 30 so as to be dipped into the developer 11 contained in the developing tank 16 and, while being passed through the pairs of feed rollers 28A, 30A and 28B, 30B, the paper 14 is gradually soaked with the developer 11. As a result, around the time when the photographic paper 14 has passed through the pair of feed rollers 28B and 30B, swollen portions, which are soaked with the developer 11, are formed near both lateral edges of the paper 14. If these swollen portions are clamped by a large pressure similar to that applied to the laterally central portion of the paper 14, compression and swelling are repeated, causing the developer 11 to soak into the swollen portions, and resulting in stains. For the purpose of preventing the occurrence of such phenomenon, the smaller-diameter portions 42 and 43 are provided so as to reduce the clamping pressure applied to the swollen portions, thereby allowing the photographic paper 14 to be fed forward without the fear of the developer 11 soaking into the edge portions of the paper 14. The diameter of each of the smaller-diameter portions 42 and 43 is set such as to be 0.1 to 0.5 mm smaller than that of the laterally central portion of the feed roller concerned. Since the dimensional difference between the smaller- and larger-diameter portions is very small as described above, illustration of the smaller-diameter portions 42 and 43 is omitted in FIGS. 2 and 4.

It should be noted that, although the feed rollers 28 to 28B and 30 to 30B have no smaller-diameter portion at the axial ends thereof, each of the feed rollers 32 to 32B has smaller-diameter portions at both axial ends, respectively, in a manner similar to that of the feed roller 32C shown in FIG. 8, so as to reduce the clamping force applied to both lateral edge portions of the photographic paper 14 which is raised in the direction of the arrow B after being turned by the roller 44 for U-turn. Since the feed rollers 28, 28A and 28B have no smaller-diameter portion, the smaller-diameter portions of the feed rollers 32, 32A and 32B are preferably provided with a dimensional difference with respect to the laterally central portion which is about twice that in the case of the feed roller 32C.

Figure 3:
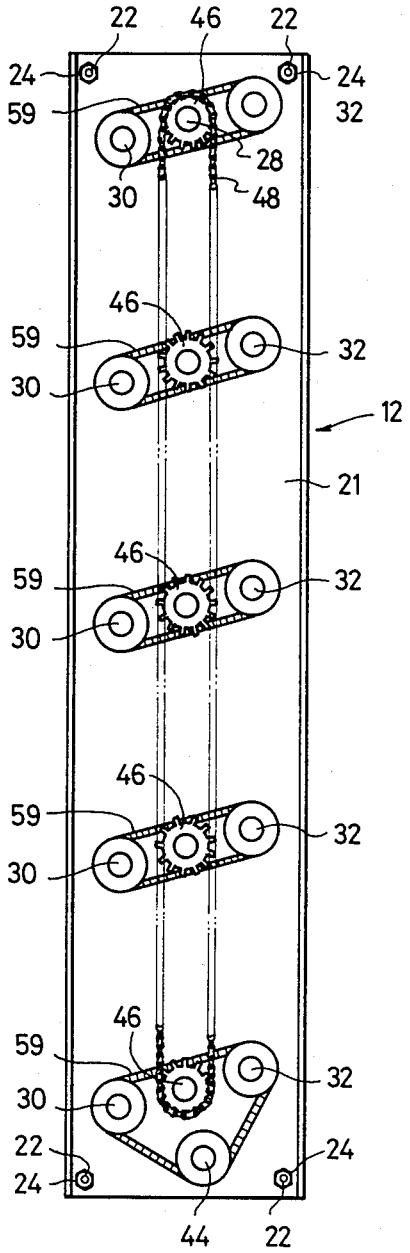
FIG. 3 is a side view of the guide structure shown in FIG. 2 as viewed from the right-hand side thereof.
Figure 5:
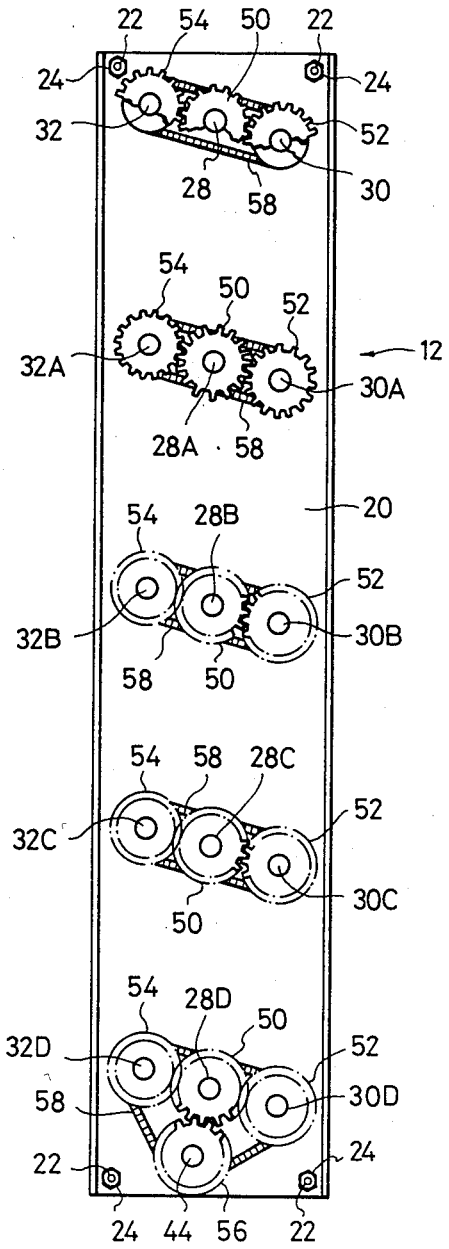
FIG. 5 is a side view of the guide structure shown in FIG. 2 as viewed from the left-hand side thereof.

One end of each of the feed rollers 28 to 28D projects outward from the side plate 21. As shown in FIG. 3, a gear 46 is rigidly secured to each projecting end, and a chain 48 is passed over the gears 46. As shown in FIG. 5, a gear 50 is rigidly secured to the end portion of the feed roller 28 which projects outward from the side plate 20, and a gear (not shown) which is driven by drive means (not shown) is meshed with the gear 50. The gear 50 is also meshed with gears 52 and 54 which are rigidly secured to the respective projecting end portions of the feed rollers 30 and 32, so that the feed rollers 30 and 32 are rotated at the same rotational speed as that of the feed roller 28 but in an opposite direction to that of the latter.

Similarly, gears 50, 52 and 54 are rigidly secured to corresponding feed rollers, respectively, which are provided below the feed rollers 28, 30 and 32 in such a manner that three feed rollers which constitute one group of feed rollers and which are in contact with each other are rotated at the same rotational speed but in different directions. A gear 56 is rigidly secured to the roller 44 for U-turn disposed at the lower end portion of the rack means 12. The gear 56 is meshed with a gear 50 which is rigidly secured to the feed roller 28D, so that the roller 44 is rotated at the same rotational speed as that of the feed roller 28D but in an opposite direction to that of the latter.

In this way, the photographic paper 14 is transported downward through the developing tank 16 in the direction of the arrow A by virtue of the interlocked operation of the feed rollers 28 to 28D and 30 to 32D. When reaching the bottom portion of the developing tank 16, the photographic paper 14 is allowed to U-turn between the feed rollers 30D and 32D by the cooperation of the feed roller 28D and the roller 44, and the paper 14 is then transported upward in the direction of the arrow B by the interlocked operation of the feed rollers 28 to 28D and 32 to 32D.

As shown in FIG. 4, the side plates 20 and 21 are provided with bearing bores for rotatably supporting the feed rollers 30 to 30D and 32 to 32D, respectively, the bearing bores being defined by slots 57 which are formed in such a manner that the respective longitudinal axes of the slots 57 extend toward the corresponding feed rollers 28 to 28D. Accordingly, the feed rollers 30 to 30D and 32 to 32D are able to come into contact with the corresponding feed rollers 28 to 28D, respectively. The feed rollers 30 to 30D and 32 to 32D are biased in directions in which they come into contact with the feed rollers 28 to 28D by means of endless tension spring rings 58 and 59 which are respectively provided outside the side plates 20 and 21 in such a manner that they are respectively stretched between the pairs of feed rollers 30, 32; 30A, 32A; 30B, 32B; 30C, 32C; and 30D, 32D, which are adapted to contact the respective feed rollers 28 to 28D from opposite sides thereof.

Bearing bores for rotatably supporting both axial end portion of the roller 44 for U-turn are similarly defined by slots 57A. One portion of the each of the endless tension spring rings 58 and 59 which are passed over the feed rollers 30D and 32D is passed over the roller 44, thus biasing the roller 44 in a direction in which it comes into contact with the feed roller 28D.

In addition, a bracket 60 for feeding the photographic paper 14 into the processing tank 18 is secured to the upper side of the rack means 12. Bent guide plates 62 having a substantially circular cross-section are provided on the bracket 60, and a pair of feed rollers 64 and 66 are provided at a position intermediate between these bent guide plates 62, whereby the photographic paper 14 fed out from the developing tank 16 is clamped between the feed rollers 64 and 66 so as to be transported while making a U-turn.

The following is a description of the operation of the above-described embodiment.

The photographic paper 14 which has been finished with a printing operating is transported along the guide 15 so that the course of the paper 14 is changed toward the feed rollers 28 and 30, and the leading end of the paper 14 is then fed into the area between the rollers 28 and 30. Since the feed roller 30 is rotating clockwise, the leading end portion of the photographic paper 14 fed into the area between the feed rollers 28 and 30 is fed out therefrom toward the leg portions 34B and 36B of the guide members 34 and 36 disposed in the manner shown in FIG. 6.

Accordingly, the photographic paper 14 thus fed out is then fed into the area between the feed rollers 28A and 30A in a state wherein the side of the paper 14 which is opposite to the emulsion-coated side is in contact with the leg portions 34B and 36B of the guide members 34 and 36, thereby preventing the emulsion-coated side from being scratched. Even when the leading end portion of the photographic paper 14 contacts the leg portions 34A and 36A, since the notches 40 are formed so as not to reach the bottom surface of the corresponding slit 37, there is no fear of the lateral edges of the leading end portion of the photographic paper 14 being caught by the notches 40. When it is transported through the area between the guide members 34 and 36, the photographic paper 14 is satisfactorily contacted by the developer 11 which moves through the area between the guide members 34 and 36 and through the notches 40, thus enabling a reliable and effective developing process to be carried out.

As the photographic paper 14 is passed through the areas between the pairs of feed rollers 28, 30; 28A, 30A; and 28B, 30B, lateral edge portions of the paper 14 gradually swells with the developer 11. However, when the photographic paper 14 is passed through the area between the feed rollers 28C and 30C, the swollen portions oppose the smaller-diameter portions 42 and 43, and there is therefore no fear of these swollen portions being subjected to a large clamping force. In consequence, no over-development takes place at the lateral edge portions of the photographic paper 14, and the paper 14 is allowed to be subjected to an appropriate developing process, and transported to the subsequent pair of feed rollers.

The photographic paper 14 is passed between pairs of feed rollers which are adjacent to each other while being appropriately guided by the guide members 34 and 36 which are disposed in a manner similar to the above, and then fed out from the area between the feed roller 28D and the roller 44 for U-turn in such a manner that the paper 14 is fed into the area between the feed rollers 28D and 32D so as to be transported in the reverse, or upward, direction. After passing through the areas between a plurality of guide members 34 and 36 and the areas between a plurality of pairs of feed rollers, the photographic paper 14 is fed out from the area between the feed rollers 28 and 32, drawn out upwardly from the developing tank 16, and transported to the subsequent processing tank 18.

When the photographic paper 14 is raised in the direction of the arrow B after making a U-turn also, both lateral edge portions thereof are subjected to a reduced clamping force by virtue of the respective smaller-diameter portions of the feed rollers 28C, 28D, and 32 to 32D, thus preventing the occurrene of discoloration such as yellowing at the edge portions due to soaking with the developer 11.

Figure 9:
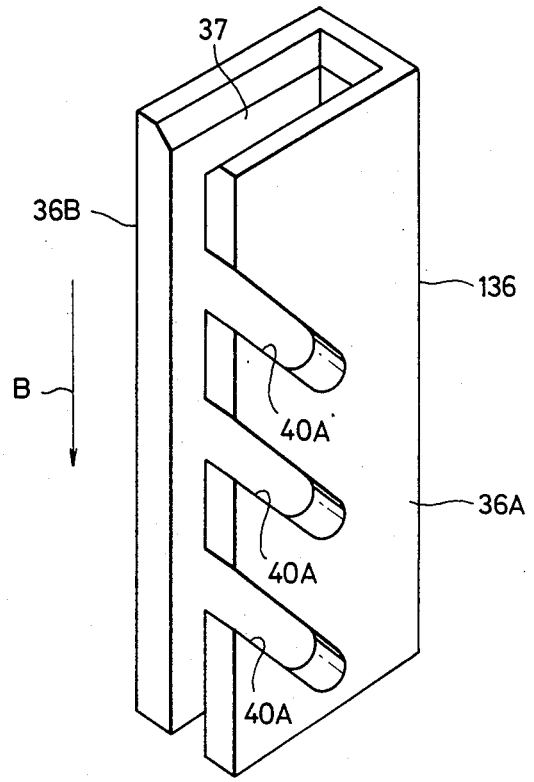
FIG. 9 is an enlarged perspective view of a modification of the guide member.

FIG. 9 shows a modification of the guide member 36 shown in FIG. 6. The modified guide member 136 has leg portions 36A, 36B and a slit 37 in a manner similar to that of the guide member 36 but differs from the latter in the configuration of notches. More specifically, notches 40A formed in the guide member 136 are relatively narrow and elongated, and the longitudinal axes of the notches 40A are inclined with respect to the photographic paper transporting direction (indicated by the arrow B).

Accordingly, there is no fear of the transported photographic paper 14 coming out of the notches 40A even when it curves or curls, and the paper 14 is guided smoothly.

In this modification also, the notches 40A are formed shallower than the slit 37 in the same manner as that in the case of the above-described guide members.

A second embodiment of the present invention will be described hereinunder with reference to FIGS. 10 and 11.

Figure 10:
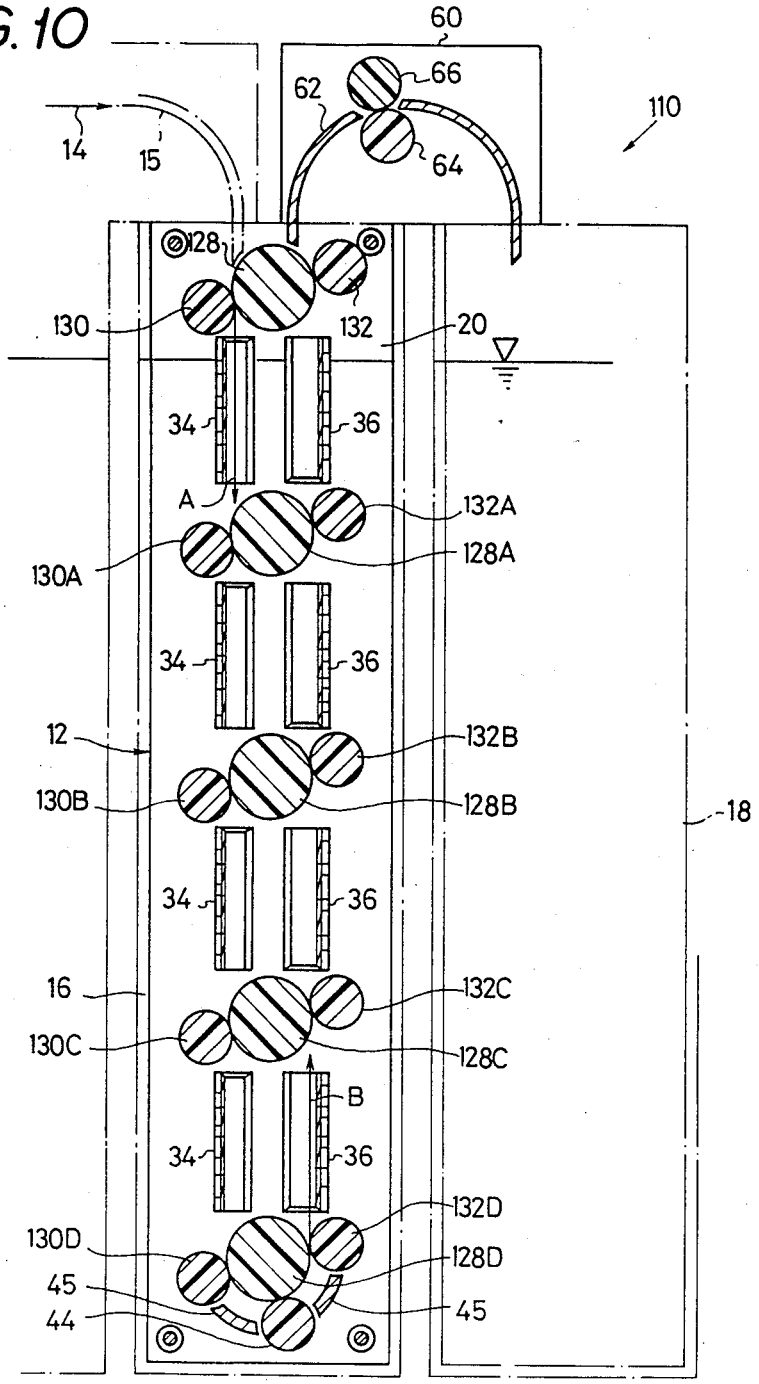
FIG. 10 shows a second embodiment of the photosensitive material guide structure for a developing apparatus according to the present invention, which corresponds to FIG. 1.

As shown in FIG. 10, the arrangement and operation of the developing apparatus 110 in this embodiment are similar to those in the first embodiment. The second embodiment slightly differs from the first embodimnt in the arrangement of the feed rollers as explained below.

Figure 11:
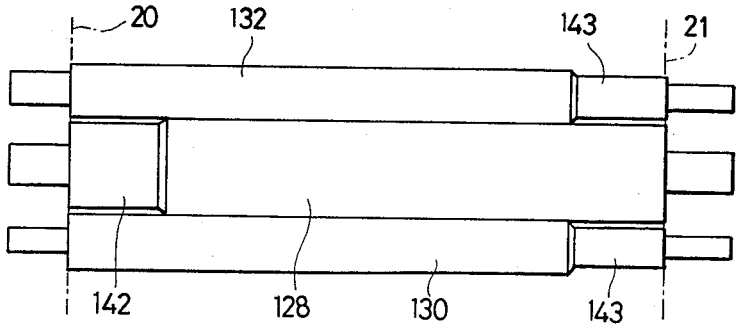
FIG. 11 is a plan view of one group of feed rollers in accordance with the second embodiment, which shows them in a contact state.

Referring to FIG. 11, a feed roller 128 has a smaller-diameter portion 142 formed at one axial end thereof, and each of the feed rollers 130 and 132 has a smaller-diameter portion 143 formed at one axial end thereof. These smaller-diameter portions 142 and 143 are adapted to oppose one lateral edge portion of the photographic paper 14 when transported. The feed rollers 128, 130 and 132 are assembled together in such a manner that the smaller-diameter portion 142 of the roller 128 opposes one lateral edge portion of the photographic paper 14 when transported, and each of the smaller-diameter portions 143 of the rollers 130 and 132 opposes the other lateral edge portion of the paper 14, thereby reducing the clamping force applied to both lateral edge portions of the photographic paper 14. More specifically, the feed rollers 128, 130 and 132 are assembled together in such a manner that the respective smaller-diameter portions 143 of the rollers 130 and 132 oppose the larger-diameter portion of the roller 128, and the smaller-diameter portion 142 of the roller 128 opposes the respective larger-diameter portions of the rollers 130 and 132. In consequence, the respective axially central portions of these rollers are brought into close contact with each other, whereas the end portions thereof are separated from each other.

As the photographic paper 14 is transported between the pairs of feed rollers within the developer 11 contained in the developing tank 16, the paper 14 is gradually soaked with the developer 11, so that swollen portions are formed near both lateral edges of the paper 14. If these swollen portions are clamped by a large pressure similar to that applied to the laterally central portion of the paper 14, compression and swelling are repeated, causing the developer 11 to soak into the swollen portions, and resulting in stains. For the purpose of preventing the occurrence of such phenomenon, the smaller-diameter portions 142 and 143 are provided so as to reduce the clamping force applied to the swollen portions, thereby allowing the photographic paper 14 to be fed forward without the fear of the developer 11 soaking into the edge portions of the paper 14. The diameter of each of the smaller-diameter portions 142 and 143 is set such as to be 0.1 to 1.5 mm smaller than that of the laterally central portion of the feed roller concerned.

It should be noted that, although each of the feed rollers 128A to 128D, 130A to 130D, and 132A to 134D similarly has a smaller-diameter portion at one axial end thereof, such smaller-diameter portions may be provided on appropriate rollers alone in correspondence with the degree to which the photographic paper 14 swells.

As has been described above, the present invention provides a photosensitive material guide structure for a developing apparatus which has at least one pair of feed rollers adapted to feed forward a photosensitive material while clamping it therebetween, wherein both axial end portions of at least one of these rollers are reduced in diameter so as to reduce the clamping force applied to both lateral edge portions of the photographic material. Accordingly, it is possible to eliminate the fear of the developer soaking into the lateral edge portions of the photographic material.

What is claimed is:

1. A photographic material guide structure for feeding a web of photosensitive material in a developing apparatus adapted to accommodate a developer and develop a photosensitive material having been subjected to light exposure, which comprises:

at least one pair of feed rollers disposed within said developing apparatus and adapted to feed forward said web of photosensitive material while clamping it therebetween, said rollers have a given diameter over a length less than the width of the web being fed therebetween, and wherein, there is a reduction in diameter at both axial end portions thereof, over distances which when added to the length of at least one roller portion of given diameter, is equal to or wider than the width of said web and wherein said guide structure further comprises guide means for maintaining said web positioned laterally centered between said rollers, such that the side edges of the web are aligned with the reduced diameter portions at the axial ends of said at least one feed roller, whereby the clamping force exerted on said web at its center portion, is in excess to that exerted on the lateral edges of said web.

2. A photosensitive material guide structure according to claim 1, wherein a plurality of pairs of said feed rollers are provided along the direction in which said photosensitive material is transported.

3. A photosensitive material guide structure according to claim 2, wherein said guide means comprises:

a pair of guide members disposed between two pairs of said feed rollers which are adjacent to each other in such a manner that said guide members oppose each other in the lateral direction of said photosensitive material, said guide members having photosensitive material passing slits respectively formed in their opposing surfaces, thus each having a substantially U-shaped planar configuration, so that both lateral edge portions of said photosensitive material are respectively guided by said guide members.

4. A photosensitive material guide structure according to claim 3, wherein the axis of one roller in each of said pairs of feed rollers is disposed a predetermined amount forward or downstream from the axis of the other roller in the photosensitive material transporting direction, so that said photosensitive material is guided while being biased toward one of the two side plates provided on each of said guide members, said side plates defining said slit.

5. A photosensitive material guide structure according to claim 4, wherein the other of said two side plates has a slanting surface extending toward the distal end thereof in such a manner that the width of said slit is increased.

6. A photosensitive material guide structure according to claim 5, wherein said other or second side plate has a plurality of notches cut from the distal end thereof at predetermined spacings, thereby allowing said developer to reach the lateral edge portions of said photosensitive material.

7. A photosensitive material guide structure according to claim 6, wherein the depth of said notches in each of said guide members is set such as to be smaller than that of said slit, thereby preventing both edges of the leading end portion of said photosensitive material from being caught by said notches.

8. A photosensitive material guide structure according to claim 7, wherein said notches have a substantially V-shaped cross-section.

9. A photosensitive material guide structure according to claim 7, wherein said notches are relatively narrow and elongated, and the longitudinal axes of said notches are inclined with respect to the direction in which said photosensitive material is guided.

10. A photosensitive material guide structure for feeding a web of photosensitive material in a developing apparatus adapted to accommodate a developer and develop a photosensitive material having been subjected to light exposure, which comprises:

at least one pair of feed rollers disposed within said developing apparatus and adapted to feed forward said web of photosensitive material while clamping it therebetween, said rollers have a given diameter over a length less than the width of the web being fed therebetween, and wherein, there is a reduction in diameter at one axial end portion of each roller, over distances which when added to the length of said at least one roller portion of given diameter, is equal to or wider than the width of said web, said pair of feed rollers being disposed in such a manner that the reduced diameter portion of one of said rollers opposes said given diameter portion of the other roller, and wherein said guide structure further comprises guide means for maintaining said web positioned laterally centered between said rollers, such that the side edges of the web are aligned with the reduced diameter portions at the axial ends of said at least one feed roller, whereby the clamping force exerted on said web at its center portion, is in excess to that exerted on the lateral edges of said web.

11. A photosensitive material guide structure according to claim 10, wherein a plurality of pairs of said feed rollers are provided along the direction in which said photosensitive material is transported.

12. A photosensitive material guide structure according to claim 11, wherein said guide means comprises:

a pair of guide members disposed between two pairs of said feed rollers which are adjacent to each other in such a manner that said guide members oppose each other in the lateral direction of said photosensitive material, said guide members having photosensitive material passing slits respectively formed in their opposing surfaces, thus each having a substantially U-shaped planar configuration, so that both lateral edge portions of said photosensitive material are respectively guided by said guide members.

13. A photosensitive material guide structure according to claim 12, wherein the axis of one roller in each of said pairs of feed rollers is disposed a predetermined amount forward or downstream from the axis of the other roller in the photosensitive material transporting direction, so that said photosensitive material is guided while being biased toward one of the two side plates provided on each of said guide members, said side plates defining said slit.

14. A photosensitive material guide structure according to claim 13, wherein the other of said two side plates has a slanting surface extending toward the distal end thereof in such a manner that the width of said slit is increased.

15. A photosensitive material guide structure according to claim 14, wherein said other or second side plate has a plurality of notches cut from the distal end thereof at predetermined spacings, thereby allowing said developer to reach the lateral edge portions of said photosensitive material.

16. A photosensitive material guide structure according to claim 15, wherein the depth of said notches in each of said guide members is set such as to be smaller than that of said slit, thereby preventing both edges of the leading end portion of said photosensitive material from being caught by said notches.

17. A photosensitive material guide structure according to claim 16, wherein said notches have a substantially V-shaped cross-section.

18. A photosensitive material guide structure according to claim 16, wherein said notches are relatively narrow and elongated, and the longitudinal axes of said notches are inclined with respect to the direction in which said photosensitive material is guided.

19. A photosensitive material guide structure for feeding a web of photosensitive material in a developing apparatus adapted to accommodate a developer and develop a photosensitive material having been subjected to light exposure, which comprises:

(a) a pair of parallel side plates disposed within said developing apparatus; and (b) at least one pair of feed rollers disposed between said side plates in such a manner that both end portions of each feed roller are rotatably supoprted by said side plates, respectively, said feed rollers being adapted to feed forward said web of photosensitive material while clamping it therebetween, and said rollers having a given diameter over a length less than the width of the web being fed therebetween, and wherein, there is a reduction in diameter at both axial end portions of at least one of said rollers, over distances which when added to the length of at least one roller portion of given diameter, is equal to or wider than the width of said web and wherein said guide structure further comprises guide means for maintaining said web positioned laterally centered between said rollers, such that the side edges of the web are aligned with the reduced diameter portions at the axial ends of said at least one feed roller, whereby the clamping force exerted on said web at its center portion, is in excess to that exerted on the lateral edges of said web.

20. A photosensitive material guide structure according to claim 19, wherein a plurality of pairs of said feed rollers are provided along the direction in which said photosensitive material is transported.

* * * * *